350-332 SR
3/29/83 XR 4,378,557

United States Patent [19]
Murata

[11] 4,378,557
[45] Mar. 29, 1983

[54] LIQUID CRYSTAL MATRIX DISPLAY

[75] Inventor: Masami Murata, Suwa, Japan

[73] Assignee: Kabushiki Kaisha Suwa Seikosha, Tokyo, Japan

[21] Appl. No.: 141,537

[22] Filed: Apr. 18, 1980

[30] Foreign Application Priority Data

Apr. 20, 1979 [JP] Japan ..... 54-49296

[51] Int. Cl.[3] ..... G09G 3/36
[52] U.S. Cl. ..... 340/805; 340/784; 350/332
[58] Field of Search ..... 340/802, 805, 784, 765; 350/332, 330

[56] References Cited

U.S. PATENT DOCUMENTS 3,845,615 11/1974 Cake ..... 340/805
3,895,372 7/1975 Kaji et al. ..... 340/784
3,981,000 9/1976 Sado et al. ..... 340/802
4,036,553 7/1977 Borel et al. ..... 350/332
4,100,540 7/1978 Fujita et al. ..... 350/333
4,121,203 10/1978 Edwards et al. ..... 350/332
4,242,679 12/1980 Morozumi et al. ..... 350/332

*Primary Examiner*—Marshall M. Curtis
*Attorney, Agent, or Firm*—Blum, Kaplan, Friedman, Silberman & Beran

[57] ABSTRACT

A liquid crystal matrix display provides scanning in a plurality of modes wherein the number of scanning electrodes simultaneously driven is varied. Higher driving duty cycles are used as the number of simultaneously driven scanning electrodes increases. Energy consumption is reduced and the quality is improved. A change-over circuit lowers the driving voltage during simultaneous scanning.

13 Claims, 13 Drawing Figures

LIQUID CRYSTAL MATRIX DISPLAY

BACKGROUND OF THE INVENTION

This invention relates generally to a liquid crystal display device of the matrix type and more particularly to a liquid crystal matrix display wherein the driving duty cycle is increased and the driving voltage is reduced when scanning electrodes are simultaneously driven as compared to the condition where scanning electrodes are independently driven. In recent years, liquid crystal display devices have been used in many types of apparatus, such as watches, clock radios, electronic calculators and the like because a liquid crystal display has the characteristics of consuming low power as compared to other types of display devices. Because this equipment, that is, watches, radios, calculators, etc. are in many instances multifunctional, it is necessary to provide a display panel on which many different kinds of information and data are to be displayed. For this reason, matrix display panels have come into common usage. In a matrix display device, information is displayed using picture elements which are formed at locations at which a plurality of scanning electrodes which are parallel one with the other, cross a plurality of signal electrodes which are parallel one with the other. Overlapped portions of the intersecting electrodes can be displayed when driven. Herein, in the conventional manner of the industry, electrodes which are oriented in a lateral direction on the display are called scanning electrodes, and those electrodes which are oriented in the lengthwise direction of the display are called signal electrodes.

As stated above, it is possible to display various types of data and information on a liquid crystal matrix display device. However, in a liquid crystal display device, because only the overlapped portions can be visibly displayed, there are portions of the electrodes which are never displayed, or in other words, electrodes are present in portions of the display where no information is ever visibly displayed. Accordingly, the total area of electrodes is larger in a matrix display as compared with a display which uses seven segments, each segment devoted to forming the portion of an alpha-numeric character. Thus, power required for charging and discharging the capacitance between the scanning and signal electrodes is greater in the matrix device as compared to a segmented device. When a conventional liquid crystal matrix display device is used in a digital wristwatch or similar battery operated device, there is the problem that battery life is short.

What is needed is a liquid crystal matrix display which consumes little power and provides a high quality presentation.

SUMMARY OF THE INVENTION

Generally speaking, in accordance with the invention, a liquid crystal matrix display especially suitable for small equipment operating from a battery source is provided. The display provides scanning in a plurality of modes wherein the number of scanning electrodes simultaneously driven is varied between different modes of operation. Higher driving duty cycles are used as the number of simultaneously driven scanning electrodes increases. Thereby, energy consumption is reduced and the quality of the display is improved. The display is driven by a generalized AC amplitude selective multiplexing method and a change-over circuit lowers the driving voltage during simultaneous scanning. In one mode of display, all scanning electrodes which remain off are combined into a group and this group is never selected for driving.

Accordingly, it is an object of this invention to provide an improved liquid crystal matrix display for operation in a plurality of modes with low power consumption and good quality of display.

Another object of this invention is to provide an improved liquid crystal matrix display wherein energy consumption is reduced in some operating modes by increasing the driving duty cycle.

A further object of this invention is to provide an improved liquid crystal matrix display where lower driving voltages are applied when the driving duty cycle is increased.

Still another object of this invention is to provide an improved liquid crystal matrix display which maintains good contrast in all operating modes regardless of the duty cycle.

Yet another object of this invention is to provide an improved liquid crystal matrix display which conserves energy by not driving electrodes which are always off in a selective mode of display.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

A liquid crystal matrix display in accordance with this invention is driven by a generalized AC amplitude selective multiplexing method. FIGS. 1*a*–1*e* are examples of driving voltage wave forms in such a multiplexing method. FIG. 1*a* is an example of a signal which is applied to a scanning electrode. The ordinate represents driving voltage and the abiscissa represents time. Between time 0 to $t_4$ is one period T. The time $t_2$, which is one half of the elapsed time from 0 to $t_4$, forms a boundary between a first frame extending from time 0 to $t_2$, and a second frame extending from time $t_2$ to $t_4$. During the second such frame the polarity of the voltage applied to the liquid crystal matrix scanning electrode is reversed from that which is illustrated in order to prevent deterioration of the liquid crystal. As explained more fully hereinafter, during the time from 0 to $t_1$ in the first frame and from $t_2$ to $t_3$ in the second frame, the scanning electrodes are selected for display.

As stated above, the picture elements for display are comprised of overlapped scanning and signal electrodes having a liquid crystal sandwiched therebetween. Whether a particular picture element is ON or OFF is determined by the signal which is applied to the signal electrode during the time period when the scanning electrodes are selected. However the signals applied to the signal electrode during the time period when the scanning electrodes are in a non-selected state has no effect in determining whether a picture element is ON or OFF. The portion of a period T during which one scanning electrode is selected is called the driving duty cycle. For example, in FIG. 1*a*, $[t_1+(t_3-t_2)]/t_4$. Thus, the driving duty cycle is the ratio of selected time to the total elapsed time of a period T.

When the number of scanning electrodes is N and the separate scanning electrodes are to be scanned individually, the driving duty cycle is 1/N where one of the N electrodes is always being driven. In the FIGS., $V_P$ is the peak voltage applied to a scanning electrode for the ON state. A ratio of the peak voltage $V_P$ to the absolute value of voltage applied to the liquid crystal scanning electrode when that electrode is not selected is a, that is, $a=V_P/V_a$.

Figure 1D:
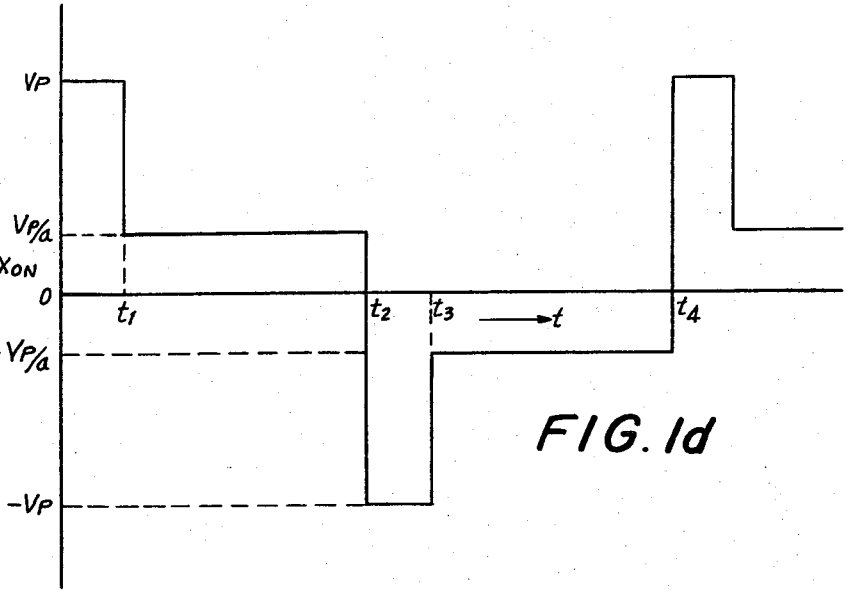
FIGS. 1*a*–1*e* show multiplexed driving voltage wave forms for a generalized AC amplitude selective method of driving a liquid crystal matrix display in accordance with this invention.
Figure 1E:
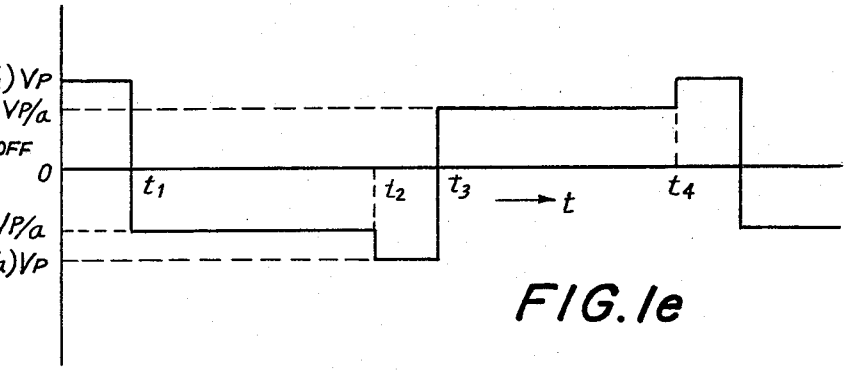
Figure 1A:
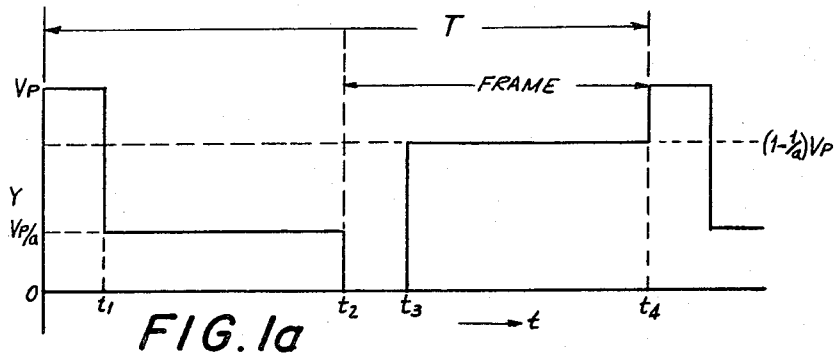
Figure 1B:
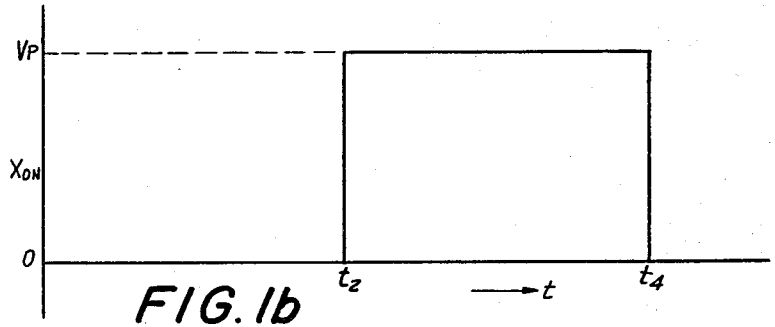
Figure 1C:
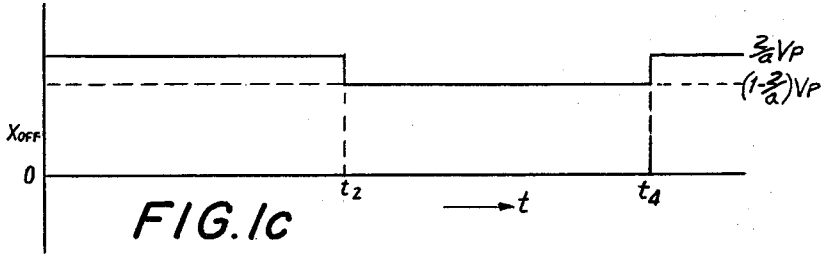

Wave forms for the driving voltages applied to the signal electrodes are shown in FIGS. 1*b* and 1*c* where the ordinate is voltage and the abiscissa is time. When a picture element is to be displayed during a period T the associated signal electrode is selected using a signal as shown in FIG. 1*b*. When a picture element is not to be displayed during a period T, the associated signal electrode which is not selected is driven by a signal as shown in FIG. 1*c*.

The instantaneous voltage difference across the opposed, overlapped electrodes of a given picture element is shown for the ON and OFF conditions in FIGS. 1*d* and 1*e* respectively. It is readily apparent in FIG. 1*d* that maximum voltage amplitudes occur during a period T in the times from 0 to $t_1$ and between $t_2$ and $t_3$ as stated above in defining the driving duty cycle.

At the time of driving in a generalized AC amplitude selected multiplexing system, the effective voltage $E_{ON}$ applied to the liquid crystal in the ON state is $$E_{ON} = \frac{V_P}{a}\sqrt{\frac{N+a^2-1}{N}}.$$

The effective voltage $E_{OFF}$ which is applied to a liquid crystal in the OFF state is $$E_{OFF} = \frac{V_P}{a}\sqrt{\frac{N+(a-2)^2-1}{N}}.$$

In these equations, N is the reciprocal of the driving duty cycle and the other terms are as described above. The ratio of the effective voltage of an OFF state to that of an ON state, namely, $$\sqrt{(N+a^2-1)/[N+(a-2)^2-1]} = \alpha.$$

This ratio, $E_{ON}/E_{OFF}$, that is, $\alpha$, is called the operation margin, which is a factor having a great effect upon the display characteristics.

Figure 2:
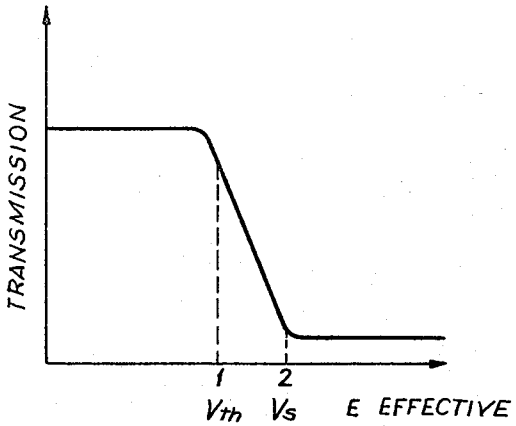
FIG. 2 is a graph of the effective voltage characteristics and light transmission of a TN-type liquid crystal cell as used in the liquid crystal matrix display in accordance with this invention.

Generally speaking, an effective voltage characteristic for the transmission of a liquid crystal cell of the TN (twisted nematic) mode is as shown in FIG. 2. The ordinate shows the transmission and the abscissa shows the effective applied voltage. When the effective voltage is increased from 0 to the value identified as 1, there is no visibility of the driven picture prior to the voltage 1 which is called the threshold voltage Vth. At the effective voltage identified as 2, visibility is substantially at its maximum and the voltage 2 is called the saturation voltage Vs. At the effective voltage 1, the transmission is 1/10 and at the effective voltage 2, the transmission is 9/10. Below the threshold voltage Vth the transmission is substantially the same as the transmission in the situation where the effective voltage is 0, that is there is essentially no visibility. Beyond the saturation voltage Vs, there is no increase in contrast. Therefore, in order to avoid half tones, it is necessary that $E_{OFF}$ be less than the threshold voltage Vth. As there is an interrelationship between the effective voltages $E_{ON}$ and $E_{OFF}$ represented by $\alpha$, the effective voltage for the ON state is ultimately restricted. It is necessary that the value of the operation margin $\alpha$ be large in order to obtain a display with good contrast. The operation margin $\alpha$ is reduced as N is increased as the equations presented above indicate because the operation margin $\alpha$ is a monotone decrease function of N. For example, when scanning the scanning electrodes independently, and the number of the scanning electrodes is N, if the number of the scanning electrodes is increased, the operation margin $\alpha$ is decreased. The contrast of the display becomes worse, as each picture element is selected for a shorter time during each period.

Accordingly, when for the purpose of the function to be displayed it is desirable that the number of scanning electrodes be increased, a method is employed such that the operation margin is maintained by increasing the bias a. As the equation above indicates, an increased value of bias a increases the value of $\alpha$. However, because in a wristwatch it is a battery which is used as a power source, it is difficult to obtain a voltage excepting a voltage which is an integral number of times greater than the output voltage of the battery. Therefore, to increase the bias a requires an increase in the peak voltage $V_P$. The energy consumed in the charging and discharging of the static capacitance between opposed electrodes is proportionate to the square of the value of voltage between the electrodes. Accordingly, as the peak voltage $V_P$ becomes large the power consumption of the liquid crystal panel is also increased. Furthermore, assuming that the frequency of the AC multiplexing drive signal is constant, the larger the number of scanning electrodes which are independently scanned, the larger is the number of times that the panel is charged and discharged. Accordingly power consumption is increased. Thus when using a liquid crystal matrix display, it is desirable that the driving duty cycle be made as large as possible from the viewpoint of power consumption. When the equipment, instrument, timepiece, etc. using a liquid crystal matrix display has a plurality of display modes, it is efficient that the device be driven with driving duty cycles as high as possible even when a particular display mode must be driven with a low driving duty cycle. Especially in a display mode which is frequently used and remains substantially fixed in its display for a long period of time, a drive with a large driving duty cycle is good for producing a reduction in the power consumption of the entire device.

As an example, a liquid crystal matrix display in accordance with this invention is utilized in an electronic watch having a TV game mode in addition to its timekeeping display modes. The display for such a watch is a liquid crystal matrix display comprising 32 by 64 picture elements, that is, 32 horizontal scanning electrodes and 64 vertical signal electrodes. The panel is driven by a fourfold matrix driving method. That is to say, the display is driven by scanning four scanning lines simultaneously using a $\frac{1}{8}$ duty cycle. Assuming that the scanning lines are called the first scanning line, second scanning line, . . . and 32nd scanning line in order from the top of the display, then scanning lines which are at intervals of 8 lines, for example, the first, ninth, seventeenth and twenty-fifth scanning electrodes are driven simultaneously.

Figure 3A:
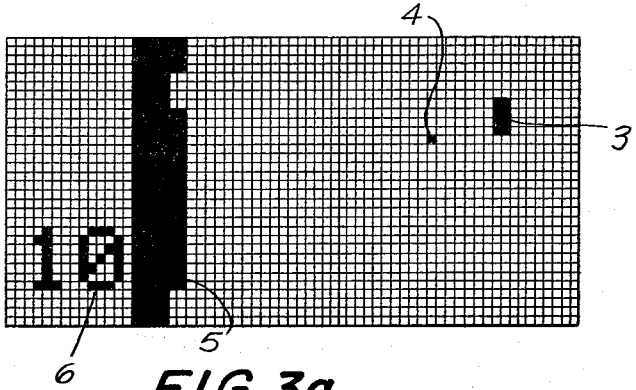
FIG. 3*a* is a liquid crystal matrix display in accordance with this invention showing a TV game mode of operation.

FIG. 3*a* shows a display using the above mentioned 32 by 64 matrix array. The panel is in a TV (television) game mode showing a racket 3, a ball 4, a block or wall 5, and a score six. In this TV game mode, the ball 4 is displayed with one picture element and moves about the entire display surface. Accordingly, the sets of 4 scanning electrodes should be scanned independently. That is, the driving duty cycle $\frac{1}{8}$ with only four scanning electrodes being driven simultaneously at all times. In this way, a single contrasted picture element representing the ball 4 can appear at any coordinates of the panel.

Figure 3B:
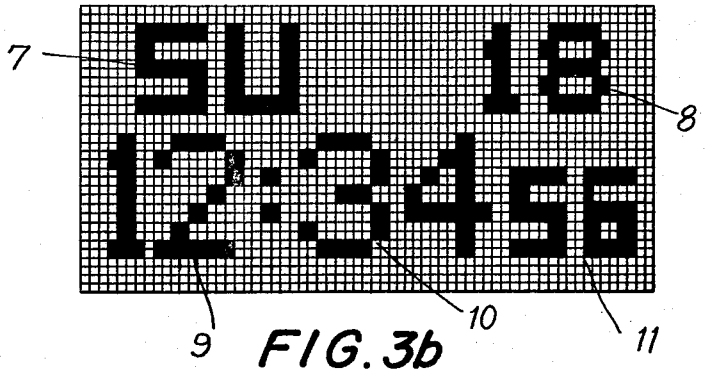
FIG. 3*b* is a liquid crystal matrix display in accordance with this invention showing a timekeeping mode of operation.

FIG. 3*b* is a display in accordance with this invention for a timekeeping mode. Appearing on the panel are the day of the week 7, data 8, hour 9, the minutes 10 and the seconds 11. As seen in FIG. 3*b*, the pattern is displayed with every visually distinguishable element having a vertical thickness of two scanning lines. The visual picture elements driven by the first scanning electrode are in the same positions as the visible elements in the second scanning line. The same conditions are applicable to the third and fourth scanning lines, the fifth and sixth scanning lines, etc. Accordingly, the first and second scanning lines can be scanned and driven at the same time, and so forth in pairs, that is the third and fourth, fifth and sixth, etc. As a result, it is possible to have a driving duty cycle of $\frac{1}{4}$. When the driving duty cycle is 1/N, the bias a for a maximum operation margin is $a=N+1$. Therefore, when 1/N is $\frac{1}{8}$, $a=3.83$ and when 1/N is $\frac{1}{4}$ $a=3$. Assuming that the power source is a silver oxide battery having an output of 1.5 volts, the voltage source which will be used to drive the display is obtained by boosting the voltage in even integral amounts, that is, 1.5, 3.0, 4.5, 6.0 V, etc. are obtainable with the proper circuits. When N is 8, and a is 4, the peak voltage $V_P$ which would be applied when both scanning electrodes and signal electrodes are selected is 6 volts. When N is 4, a is 3, then a peak applied voltage $V_P$ would be 4.5 volts. Using the above equations, the values for on and off voltages can be calculated and the following results are obtained.

$N=8$; $a=4$; $V_P=6.0(V)$; $E_{ON}=2.54(V)$; $E_{OFF}=1.76(V)$; $\alpha=1.44$ (Game Mode)

$N=4$; $a=3$; $V_P=4.5(V)$; $E_{ON}=2.59(V)$; $E_{OFF}=1.5(V)$; $\alpha=1.73$ (Timekeeping Mode)

It can be seen that in the timekeeping mode where $N=4$, in spite of the lowered supply voltage, the timepiece is driven with an operation margin $\alpha$ better than in the TV game mode. When the supply voltage is lowered, that is 4.5 volts instead of 6.0, power consumption is decreased. Assuming that in the timekeeping mode and in the TV game mode the AC drive has the same frequency, the number of times which the capacitor of the display panel is charged and discharged in a unit of time is less than in the mode which has a larger duty cycle. This also improves power consumption in the timekeeping mode. Thus power is saved by the lower voltage in the higher duty cycle while contrast is preserved.

Figure 4:
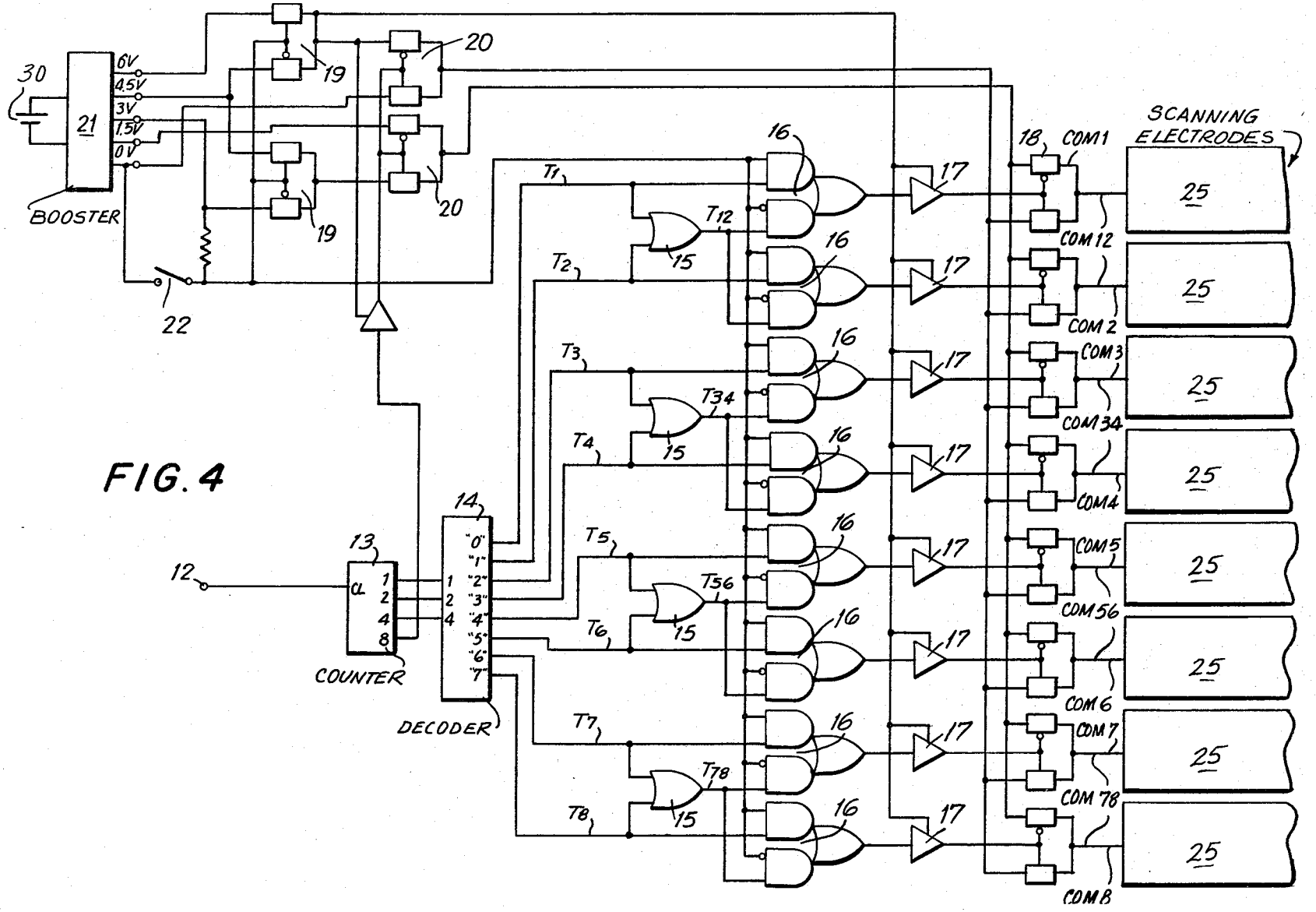
FIG. 4 is a circuit for generating scanning signals for a liquid crystal matrix display in accordance with this invention.
Figure 5B:
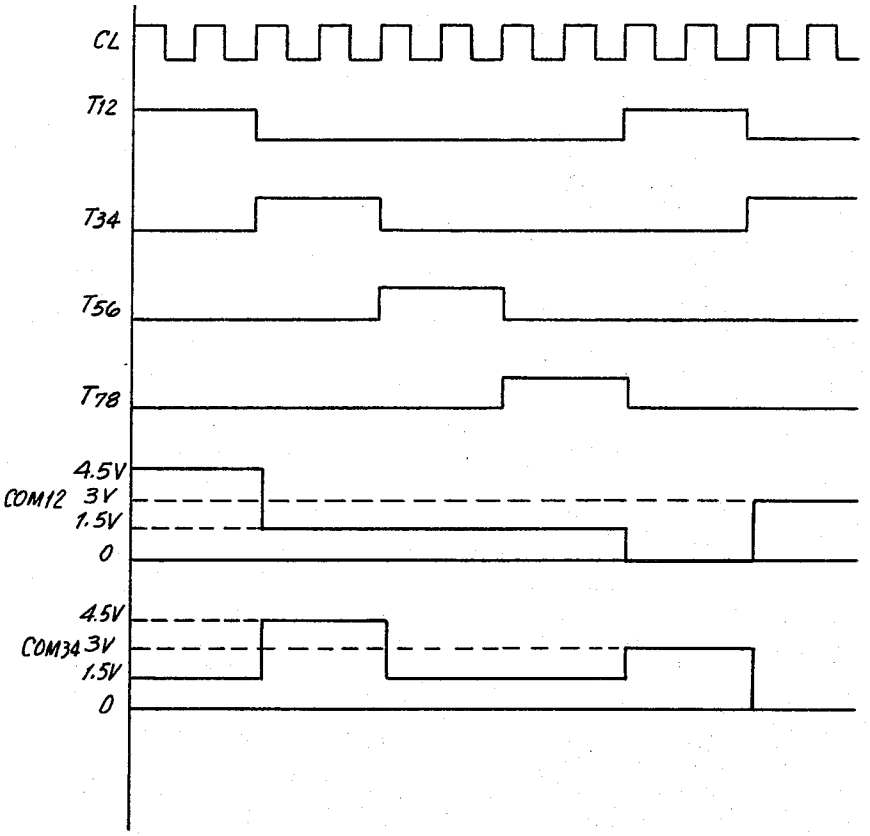
FIG. 5*b* is a timing chart of the circuit of FIG. 4 operating in another duty cycle mode.
Figure 5A:
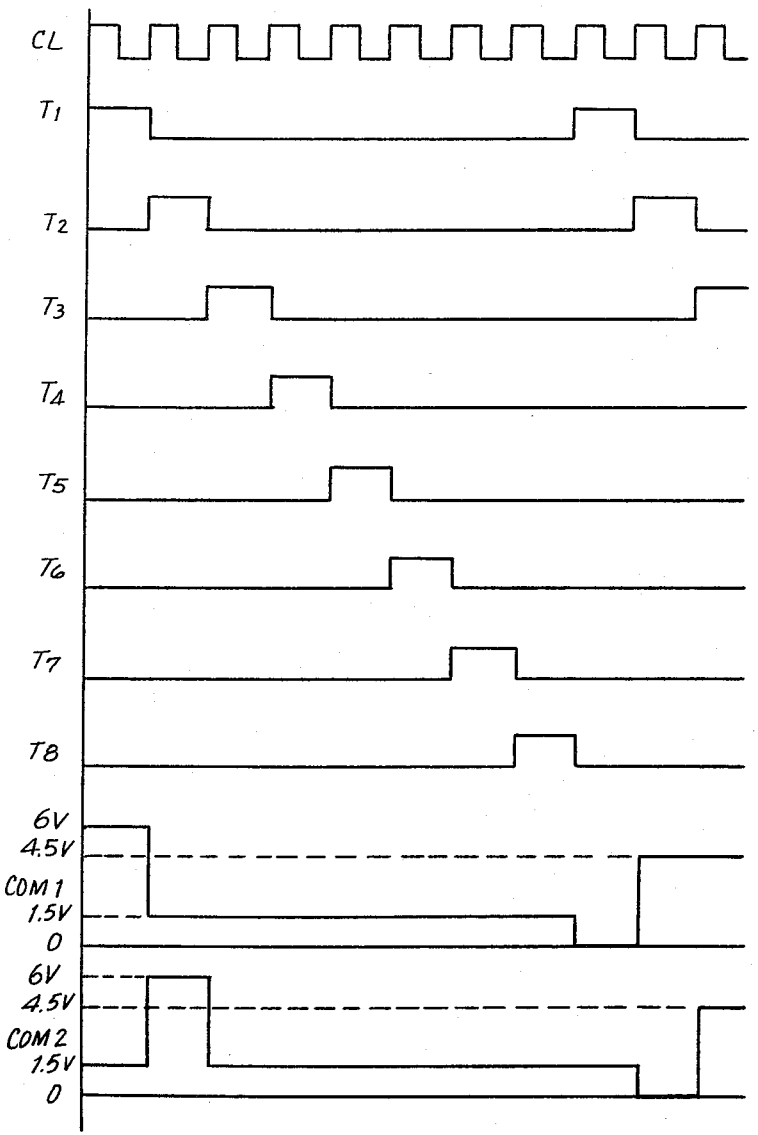
FIG. 5*a* is a timing chart of the circuit of FIG. 4 operating in one duty cycle mode.

FIG. 4 is a circuit for generating scanning signals for a liquid crystal matrix display in accordance with this invention. The circuit comprises a clock input terminal 12, binary counter 13, decoder 14, four OR gates 15, eight AND-OR gates 16, nine level shifters 17, eight analogue multiplexers 18, a pair of multiplexers 19 for changing a voltage level, a pair of multiplexers 20 for driving a liquid crystal panel with an AC signal, a voltage booster circuit 21, a mode changeover switch 22, and scanning electrodes 25. Eight scanning electrodes 25 are illustrated. A battery power source 30 drives the circuit. A logic level of 3 volts is high and logic level of 0 volts is low in portions of the circuit component elements 13 to 16. When a clock pulse 12, having the same period as that which is used in selecting the scanning electrodes, is input at the terminal 12, and when a $\frac{1}{8}$ driving duty cycle for multiplexed driving is used, a binary counter 13 inputs a binary code to the decoder 14 in accordance with the number of pulses which are input into the counter 13. The three digit binary code input to the decoder 14 is converted into eight signals $T_1$ to $T_8$ as shown in FIG. 5*a*. The duration of the high state of signals $T_1$ to $T_8$ corresponds to the time period during which respective scanning electrodes are selected. For the TV game mode where a $\frac{1}{8}$ duty cycle multiplex driving signal is delivered, because the switch 22 is open, the control terminal of each AND-OR gate 16 becomes high in turn and signals $T_1$ to $T_8$ are outputted with a high having a duration as indicated in FIG. 5*a*. The signals $T_1$ to $T_8$ after their level is converted by the level shifter 17 are applied to the respective scanning electrodes so that voltage driving signals generated at the booster circuit 21 may be passed through to the scanning electrodes 25.

In FIG. 5*a* a driving signal COM 1 applied to the uppermost scanning electrode 25 (FIG. 4) and resulting from the signal $T_1$ is shown. A driving signal COM 2 for the adjacent scanning electrode signal 25 is also shown. When the eighth pulse is input to the counter 13, the counter 13 is reset and the output 8 of a counter 13 changes from high to low, or from low to high, and this output signal from the counter 13 is applied to a control circuit 20. When the signal from the output 8 of counter 13 is applied to the multiplexers 20, the voltage outputs of the multiplexers 20 changes with each change in the output signal 8. Accordingly, new voltage values are applied to the multiplexers 18 and a different multiplex pattern of voltages is applied to the scanning electrodes in the second portion of a period T as illustrated, for example in FIG. 1*a* and FIG. 1*b* and partially shown in FIG. 5*a* where only the first frame and a portion of the second frame of a period T is shown.

The wave forms of FIG. 5*a* present conditions in the circuit of FIG. 4 when the switch 22 is open such that the circuit outputs signals for a $\frac{1}{8}$ duty driving cycle and the scanning electrodes 25 are scanned independently in sequence. When the switch 22 is closed, multiplexing signals are provided with a $\frac{1}{4}$ duty cycle and this duty cycle is suitable for the timekeeping mode of operation as shown in FIG. 3*b*. When the switch 22 is open, as described above, one input to the AND portions of the AND-OR gates 16 is at a 3 volt potential. This 3 volt signal enabled those AND gates having conventional inputs and disabled those AND gates having inverted inputs. Thus the signals COM 1–COM 8 are produced. When the switch 22 is closed a zero voltage signal replaces the three volt signals at the input to the AND gates of the AND-OR combinations 16. Thereby gates enabled during the $\frac{1}{8}$ duty cycle become disabled during the $\frac{1}{4}$ duty cycle and vice versa. As a result the multiplexers 18 are controlled indirectly by the outputs of the OR gates 15 which now feed signals to the AND-OR combinations 16. The outputs of the OR gates 15 are the logical sum of signals $T_1$ and $T_2$ to produce the signal $T_{12}$, the sum of $T_3$ and $T_4$ to produce the output signal $T_{34}$, the sum of $T_5$ and $T_6$ to produce the output signal $T_{56}$, and the sum of the signals $T_7$ and $T_8$ to produce the output signal $T_{78}$. These four output signals are input to the control terminals of the multiplexers 18 through the level shifters 17 with the result that the scanning electrodes are driven in adjacent pairs, that is, the upper two scanning electrodes 25 (FIG. 4) are driven simultaneously as a result of the signal $T_{12}$.

Then the third and fourth, fifth and sixth, and seventh and eighth electrodes 25 are driven in pairs in sequence. As seen in FIG. 5*b* the duration of the scanning signals produced for the $\frac{1}{4}$ duty cycle is twice as long as the duration of the signals (FIG. 5*a*) produced for the $\frac{1}{8}$ duty cycle. The other circuit elements operate as described above with the result that driving signals to the scanning electrodes, now driven in pairs, are as indicated, for example in FIG. 5*b*, as COM 12 and COM 34, etc.

The polarity of the scanning signals is inverted by the output signal 8 of counter 13 changing and the liquid crystals are thereby driven by an AC signal. The change from a 4.5 volt drive to 6.0 volt drive or from 6 volt drive to 4.5 volt drive of the multiplexers 19 is accomplished by signals derived from opening and closing the switch 22. The circuit for generating the driving signals for the signal electrodes is not shown herein for it does not constitute a novel portion of this invention. However, it is necessary to change over the circuits which produce the signals for the signal electrodes in accordance with the functional mode which is being displayed.

Figure 6:
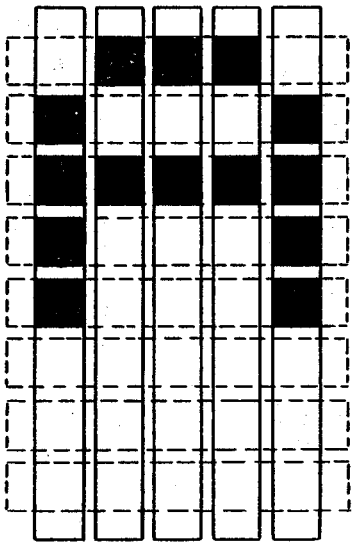
FIG. 6 is a liquid crystal matrix display having eight scanning electrodes wherein a character is displayed on 5×5 dots.
Figure 7:
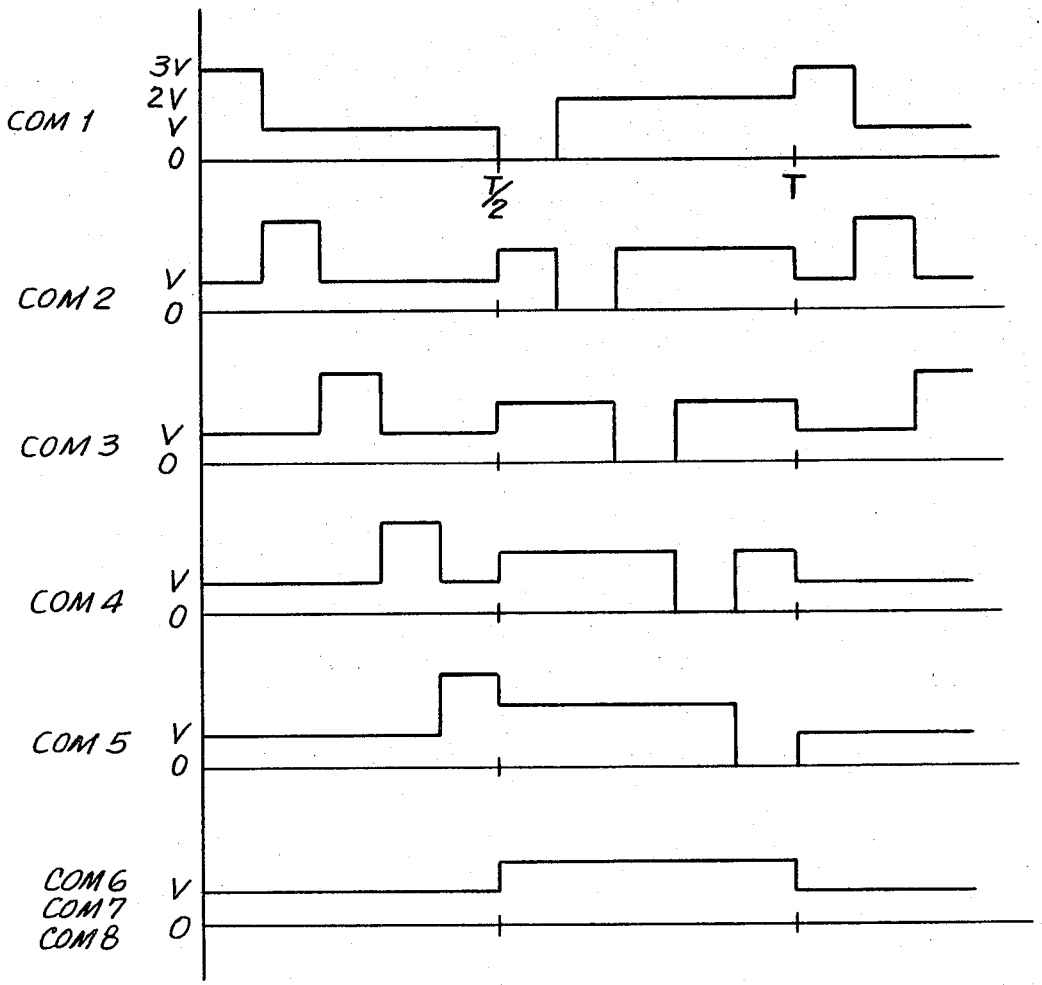
FIG. 7 is a wave form diagram of scanning signals which display the characters shown in FIG. 6.

Power consumption, which is generally considered to be the disadvantage of a liquid crystal matrix display device, is made small by changing the driving duty cycle in accordance with each mode of display by means of comparatively simple circuits as exemplified by the circuit described above. By raising the driving duty cycle, better pictures are obtained with a lower power consumption. There is a situation where the driving duty cycle can be further increased with further improvement in quality and power consumption. That is to say, in the case where the characters are made appear on the $5\times5$ dots of the matrix display which has eight scanning electrodes extending horizontally, as shown in FIG. 6, the upper five scanning electrodes must be scanned independently, however at that time the picture elements formed with the lower three scanning electrodes are entirely OFF. In such a mode, it is possible to apply the scanning signal which has no selection period to the lower three scanning electrodes simultanenously. The scanning signals which appear at that time are shown in FIG. 7, wherein COM 1 shows the first scanning electrode and the others show scanning electrodes respectively. FIG. 7 is a wave form diagram wherein the bias is 3 and the frame period is T.

However, since the effective voltage applied to the liquid crystal of the picture elements formed with COMs 6 to 8 is less than that of picture elements formed with COMs 1 to 5 in OFF state, the effective voltage of picture elements formed with COMs 1 to 5 in OFF state should be less than the threshold voltage of the liquid crystal.

As stated above, total power consumption of an apparatus which uses a liquid crystal matrix display can be reduced by increasing the driving duty cycle and lowering applied voltages in accordance with the modes which are displayed. This invention promotes the use of a liquid crystal matrix display in applications where it has been rarely used because of the large power consumption.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a liquid crystal matrix display having picture elements formed at the overlapped intersections of a plurality of first electrodes with a plurality of second electrodes, the improvement therein comprising:

first circuit means for selecting among and generating driving signals for said plurality of first electrodes;

second circuit means for generating driving signals for said plurality of second electrodes, the voltage difference of said driving signals at said picture elements determining individually the ON or OFF state of each said picture element, said voltage difference providing an AC multiplexed drive, said multiplex signals being synchronized by a clock signal;

said first circuit means including switch means for controlling the mode of operation of said first circuit means, said first circuit means being subject to operate in at least two modes dependent upon the state of said switch means, in each said mode the number of said first electrodes simultaneously selected and driven by the same signal differing, said first circuit means being adapted to increase the driving duty cycle of said multiplexed signal when the quantity of said simultaneously driven first circuit electrodes increases in accordance with the state of said switch means, simultaneous driving of selected electrodes reducing the number of required driving signals in a fixed time period for said selected electrodes, power being conserved by simultaneous operation of a greater number of picture elements at higher duty cycles.

2. In a liquid crystal matrix display having picture elements formed at the overlapped intersections of a plurality of first electrodes with a plurality of second electrodes, the improvement therein comprising:

first circuit means for selecting among and generating driving signals for said plurality of first electrodes;

second circuit means for generating driving signals for said plurality of second electrodes, the voltage difference of said driving signals at said picture elements determining individually the ON or OFF state of each said picture element;

said first circuit means including first switching means for controlling the mode of operation of said first circuit means, said first circuit means being subject to operate in at least two modes dependent upon the state of said first switching means, in each said mode the number of said first electrodes simultaneously selected and driven by the same signal differing, said first circuit means being adapted to increase the driving duty cycle of said difference signal when the quantity of said simultaneously driving first circuit electrodes increases in accordance with the state of said first switching means, simultaneous driving of selected electrodes reducing the number of required driving signals in a fixed time period for said selected electrodes, power being conserved by simultaneous operation of a greater number of picture elements at higher duty cycles, said first circuit means for selecting and driving further including means for raising and lowering the driving voltage for said selected first electrodes and for applying a relatively lower voltage to said modes having greater duty cycles, whereby power is further conserved

3. A liquid crystal matrix display as claimed in claim 2, wherein said means for raising and lowering said driving voltage includes second switch means intermediate a voltage source and said circuit means for selecting and driving, said voltage source having a plurality of outputs at different voltage levels.

4. A liquid crystal matrix display as claimed in claim 2 or 3, wherein said driving signals are multiplexed, said multiplex signals being synchronized by a clock signal.

5. A liquid crystal matrix display as claimed in claim 4, wherein said means for raising and lowering said driving voltage further includes counter means, said counter means counting said clock signals, a selected output state of said counter means triggering said second switch means to change the voltage level of said driving signals to said first electrodes, whereby regularly periodic changes in voltage levels are produced in said multiplexed signals.

6. A liquid crystal matrix display as claimed in claim 5, wherein said circuit means for selecting and driving further includes a decoder, said decoder receiving the outputs of said counter means and outputting in sequence first electrode selecting signals, the number of said selecting signals outputted from said decoder at least equalling the number of said first electrodes in said plurality of first electrodes, whereby each said first electrode may be independently driven.

7. A liquid crystal matrix display as claimed in claim 6 wherein said circuit means for selecting and driving further includes logic means intermediate said decoder and said first electrodes, said first switching means when in one condition causing said selecting signals to pass through said logic means directly to said first electrodes whereby said first electrodes are independently driven, said second switching means when in a first condition causing said logic means to logically combine at least two of said outputs of said decoder and simultaneously drive at least two of said first electrodes, the number of said simultaneously driven first electrodes equalling the number of said decoder outputs being combined by said logic means.

8. A liquid crystal matrix display as claimed in claim 7, wherein said first switching means causes the output from said voltage source applied to drive said selected first electrodes to drop when said selected first electrodes are not driven independently.

9. A liquid crystal matrix display as claimed in claim 4, wherein said multiplexed signals are AC.

10. A liquid crystal matrix display as claimed in claim 7, wherein said logic means includes for each said first electrode a first OR gate, said first OR gate having at least an input from a first and a second AND gate, the second AND gate having an inverted input, an input of each first AND gate and said inverted input of each second AND gate being connected to said first switching means, whereby a selected high or low condition at said first switching means, selects between said first and second AND gates for driving said first OR gate.

11. A liquid crystal matrix display as claimed in claim 10, wherein said selecting signals from said counter are selectively applied to another input of said first AND gates.

12. A liquid crystal matrix display as claimed in claim 11, and further comprising second OR gates for every at least two first electrodes, said second OR gates having inputs connected to at least two consecutive outputs of said counter means, the output of said second OR gates being inputted to the non-inverted inputs of said second AND gates associated with said at least two first electrodes, whereby said at least two first electrodes are simultaneously driven when said first switching means is in a low condition.

13. A liquid crystal matrix display as claimed in claim 2, wherein, in a selected functional mode, a portion of said first electrodes is not driven for display, said non-displayed first electrodes being combined, said circuit means for selecting and generating being adapted to omit selection of said combined non-displayed first electrodes, whereby selected first electrodes have a longer duty cycle and power is further conserved.

* * * * *